US005119649A

United States Patent [19]

Spence

[11] Patent Number: 5,119,649

[45] Date of Patent: Jun. 9, 1992

[54] LOCKING DEVICE FOR RECREATIONAL ARTICLES

[76] Inventor: Jay W. Spence, 40 Gema, San Clemente, Calif. 92672

[21] Appl. No.: 610,378

[22] Filed: Nov. 6, 1990

[51] Int. Cl.[5] ..... E05B 73/00

[52] U.S. Cl. ..... 70/14; 70/18; 70/58; 114/172

[58] Field of Search ..... 114/172; 441/63; 70/14, 70/18, 30, 49, 54-58, 158, 164, 166

[56] References Cited

U.S. PATENT DOCUMENTS

| | | | |
|---|---|---|---|
| 1,386,778 | 8/1921 | Gray | 70/49 |
| 4,098,100 | 7/1978 | Wah | 70/38 A |
| 4,112,716 | 9/1978 | Wippich | 70/52 X |
| 4,134,280 | 1/1979 | Pelavin | 70/55 |
| 4,340,376 | 7/1982 | Williams | 441/74 |
| 4,407,146 | 10/1983 | Nielsen, Jr. | 70/18 X |
| 4,466,375 | 8/1984 | Marker | 114/90 |
| 4,526,125 | 7/1985 | Bain, Jr. | 70/18 X |
| 4,712,394 | 12/1987 | Bull | 70/18 |
| 4,740,182 | 4/1988 | Pertramer | 441/74 |
| 4,820,220 | 4/1989 | Fruzzetti et al. | 441/74 |
| 4,938,040 | 7/1990 | Humphreys, Jr. | 70/58 |
| 4,938,725 | 7/1990 | Beck | 441/75 |

*Primary Examiner*—Lloyd A. Gall

*Attorney, Agent, or Firm*—Knobbe, Martens, Olson & Bear

[57] ABSTRACT

A locking apparatus for use with surfboards and other articles which attaches to a cross bar on the article. The locking apparatus includes a member which surrounds the cross bar and a means for locking and unlocking the member to the cross bar thereby preventing unauthorized persons from removing the member from the cross bar. Used with a conventional surfboard, the lock apparatus advantageously attaches to an existing leash plug cross bar, requiring no modification or retrofit to the surfboard, and attaches without removal of a leash cord which likewise typically attaches to the cross bar. Further, a cable secures to the locking apparatus and is looped around or affixes to a generally stationary structure, such as an automobile surfboard roof rack, bicycle rack, post, etc., in order that the article cannot be moved without first unlocking the member.

1 Claim, 4 Drawing Sheets

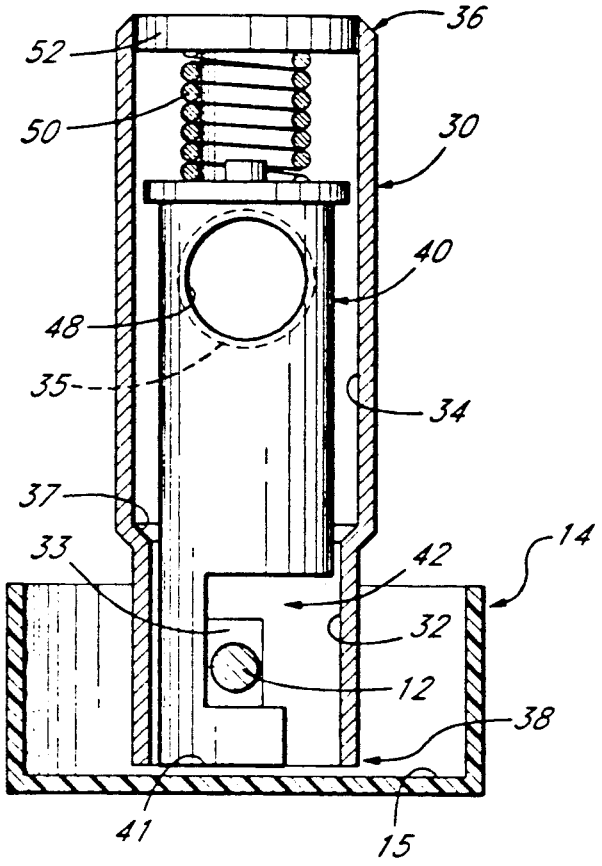
Fig. 3
Fig. 4
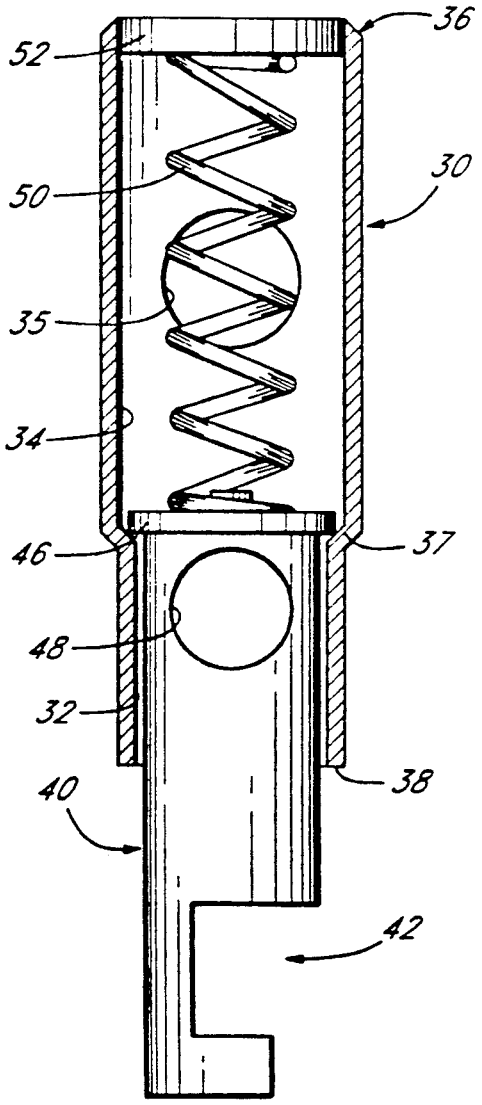

LOCKING DEVICE FOR RECREATIONAL ARTICLES

BACKGROUND OF THE INVENTION

The invention relates generally to the field of locks, and more particular surfboard using an existing cross bar embedded within the surfboard.

Recreational articles such as surfboards, sailboards, wave riders, kayaks and the like, are all expensive and subject to theft. Protection from theft, however, is difficult because of the nature of use and the structure of these articles. These articles are generally too large to fit comfortably within a passenger vehicle and users of these articles typically carried them by hand to the outdoor environment in which they are used. Thus, the articles generally cannot be secured within a stationary housing during short periods of non-use. Moreover, these articles typically have smooth exterior surfaces formed of fiberglass, making attachment of locking devices difficult.

A number of locking devices have been developed to prevent theft of these articles. The patent to Williams (U.S. Pat. No. 4,430,376) discloses a padlock eye which attaches to the base of the surfboard skag by means of a retaining screw retained in a skag box. The patent to Ball (U.S. Pat. No. 4,712,394) discloses a cylindrical sleeve inserted through a surfboard blank providing passage for a securing cable. When using the surfboard, a detachable plug inserts into the sleeve.

Another method and apparatus for securing such articles is disclosed in the patent to Bain, Jr. (U.S. Pat. No. 4,526,125). The securing system of Bain includes a pair of hoops having diameters adapted to slip over the ends of a kayak or similarly shaped elongated objects. A cable stretches between the hoops preventing the hoops from slipping off once placed on the article. An additional cable secures one hoop to a stationary body by use of a padlock.

The patent to Fruzzetti, et.al. (U.S. Pat. No. 4,820,220) discloses a further securing device for attaching a cable to a surfboard for use as a tether or a lock cable. A flanged anchor with a threaded interior bore is embedded within the surfboard. When securing the surfboard to a stationary object, the user must disassemble the tether coupling mechanism and replace it with the lock cable coupling mechanism which threads into the interior bore by use of a dedicated key.

All of the above devices suffer from a number of drawbacks. First, a majority of the devices damage the articles which the locks are intended to protect, either during installation or during use. Conventionally, surfboard and sailboard manufactures do not incorporate the devices disclosed in the Ball and Fruzzetti, et.al. patents when manufacturing the boards. Consequently, these devices tend to be a retrofit item. Retrofitting an article with these devices, however, tends to cause damage to the article by cracking and splintering fiberglass layers when drilling holes within which to insert these devices.

Damage may be caused by other means as well. For example, Bain requires securing a pair of hoops on opposite ends of an article by tightening a cable attached to each hoop. In order to prevent the hoops from being pulled off the ends of the article, the cable must be taut. Applying such force to the article, however, may lead to dings and cracks in the fiberglass layers of the article.

A second drawback is that contemporary surfboard designs omit the skag box and rigidly secure the fin or fins directly to the surfboard blank. Therefore, the device disclosed in the Williams reference will not work with the majority of surfboard produced today.

Finally, a majority of the above devices are not readily attachable to the articles sought to be protected. Williams and Fruzzetti, et.al. require removal of the skag or tether, respectively, in order to lock the board to a stationary object. The Bain system requires slipping a hoop over each end of the article and tightening a cable between the hoops.

Thus, a need exists for a simple locking device, readily attachable to conventionally existing structure of a surfboard or other such recreational article, which will not damage the article when attached.

SUMMARY OF THE INVENTION

The present invention defines a lock apparatus attachable to an existing cross bar of a standard leash plug which is conventionally positioned in a surfboard as original equipment. The lock apparatus comprises a member which surrounds the cross bar and which is selectively removable therefrom. In other words, the member locks around the cross bar and includes means for preventing unlocking the member by unauthorized persons. Further, a cable is secured to the lock apparatus and is designed to be looped around or affixed to a generally stationary structure, such as an automobile roof rack, bicycle rack, etc., in order that the surfboard cannot be moved without first unlocking the member. Additionally, the member attaches to the existing cross bar without removal of a leash cord typically attached to the cross bar.

Broadly defined, the invention comprises a lock apparatus attachable to a cross bar formed in or secured to an article sought to be protected against theft. The term "article" as used in the claims should be construed as a general rubric for items such as surfboards, sailboards, wave riders, kayaks, boats, skateboards, bicycles and like items.

A preferred embodiment of the present invention comprises a casing, a bolt and a means for selectively preventing movement of the bolt relative to the casing. The casing includes an inner bore and structure to surround the cross bar of the article. The bolt moves within the casing inner bore between a lock position which locks the cross bar between the casing and the bolt, and an unlock position permitting movement of the lock apparatus away from the cross bar. The means for selectively preventing movement of the bolt locks the cross bar in the lock position.

Defined more specifically, the casing is tubular with an inner diameter bore, and includes a transverse hole through the casing proximal to one end of the casing, and a pair of parallel slots extending longitudinally from the other casing end and sized to receive the cross bar. The bolt slides within the inner diameter bore and extends beyond the slotted end of the casing in the unlock position. The bolt includes a hole proximal to one end of the bolt and a reduced cross-sectional portion forming a notch adapted to receive the cross bar and proximal to the other end of the bolt. In this manner, the notch extends beyond the recessed end of the casing in the unlock position. The hole is located such that the hole of the bolt aligns with the hole of the casing in a manner to receive a locking member through the holes with the bolt in the lock position. The locking member may comprise a shackle of a padlock or other types of keepers.

A second preferred embodiment defines a kit comprising the previously defined lock apparatus, a padlock and a cable. As discussed above, the shackle of the padlock locks in place the lock apparatus attached to the existing cross bar. The cable loops around or affixes to a substantially stationary object. The looped end or ends of the cable may then be locked to the lock apparatus by the padlock shackle.

A third preferred embodiment of the invention integrates a lock and a cable with the basic elements of the casing and the bolt. The casing, similar to the one defined above, includes a cavity adapted to receive a lock cylinder and a throw lever.

In the third preferred embodiment, the means of preventing bolt movement from the lock position differs from the means disclosed above. Instead of passing a padlock shackle through the series of aligned holes in the bolt and casing, movement of the bolt is prevented by engaging the throw lever with a groove cut into the bolt.

Preferably, the throw lever couples to the lock cylinder in a manner communicating rotation of the lock cylinder to the throw lever. Other mechanism, however, may be employed to selectively move the throw lever into engagement with the bolt groove when the bolt is in the lock position. The essential criteria is that only selective individuals, i.e., authorized persons, may invoke the movement of the throw lever into and out of engagement with the bolt.

The lock apparatus is preferably formed of a metal alloy, such as brass, and coated with a plastic or rubber film to protect the article from damage. Alternatively, the lock apparatus could be formed from plastic or a like material.

The present invention also includes a method of locking an article using a cross bar within the article's structure and the present lock device. In use, the bolt of the present lock device engages the cross bar by positioning the cross bar within the bolt notch. Next, the casing slides over the bolt to a position receiving the cross bar and locking it between the bolt and the casing. Finally, movement of the bolt relative to the casing is prevented. In this manner, the lock device is securely attached to the cross bar of the article.

BRIEF DESCRIPTION OF THE DRAWINGS

FIG. 3 is a cross-sectional view of the lock apparatus of FIG. 1 taken along line 3—3;

FIG. 4 is a cross-sectional view of the lock apparatus of FIG. 1 showing the lock apparatus in the unlock position;

DESCRIPTION OF THE PREFERRED EMBODIMENTS

Figure 1:
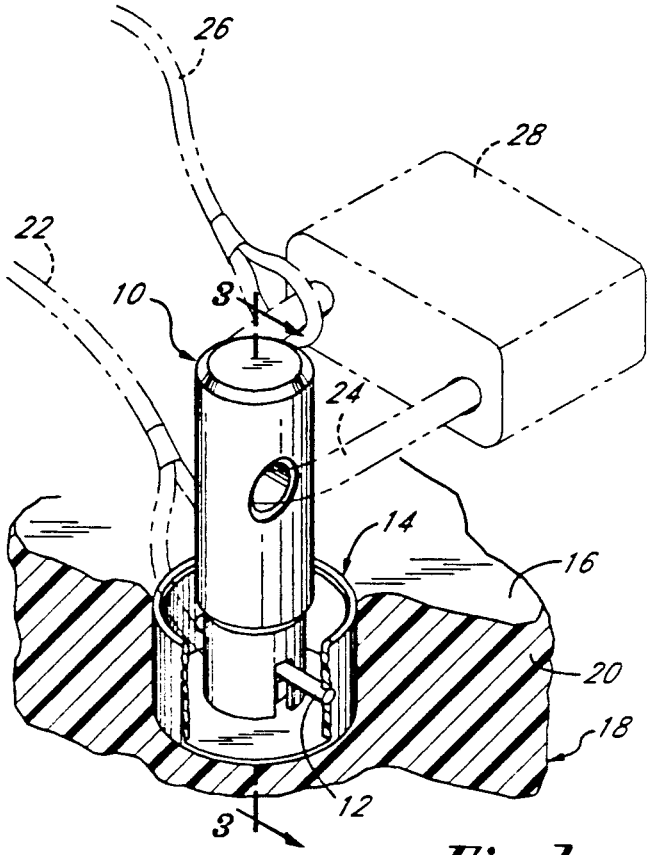
FIG. 1 is a perspective view of one preferred embodiment of the present invention, secured to a cross bar of a surfboard leash plug by a padlock.

FIG. 1 shows one preferred embodiment of the present lock apparatus 10 attached to an existing cross bar 12 which spans across a standard cup-shaped leash plug 14. Conventionally, the leash plug 14 is positioned in a surfboard 18 with the top of the plug 14 flush with a fiberglass outer layer 16 of the surfboard 18. The surfboard has an inner foam blank 20 having a hole within which the plug 14 nests. The hole in the foam blank 20 is formed prior to layering the foam blank 20 with the fiberglass 16 and thereby securing the leash plug 14 within the surfboard 18. A leash cord 22 is typically tied to the cross bar 12 as a tether.

Figure 2:
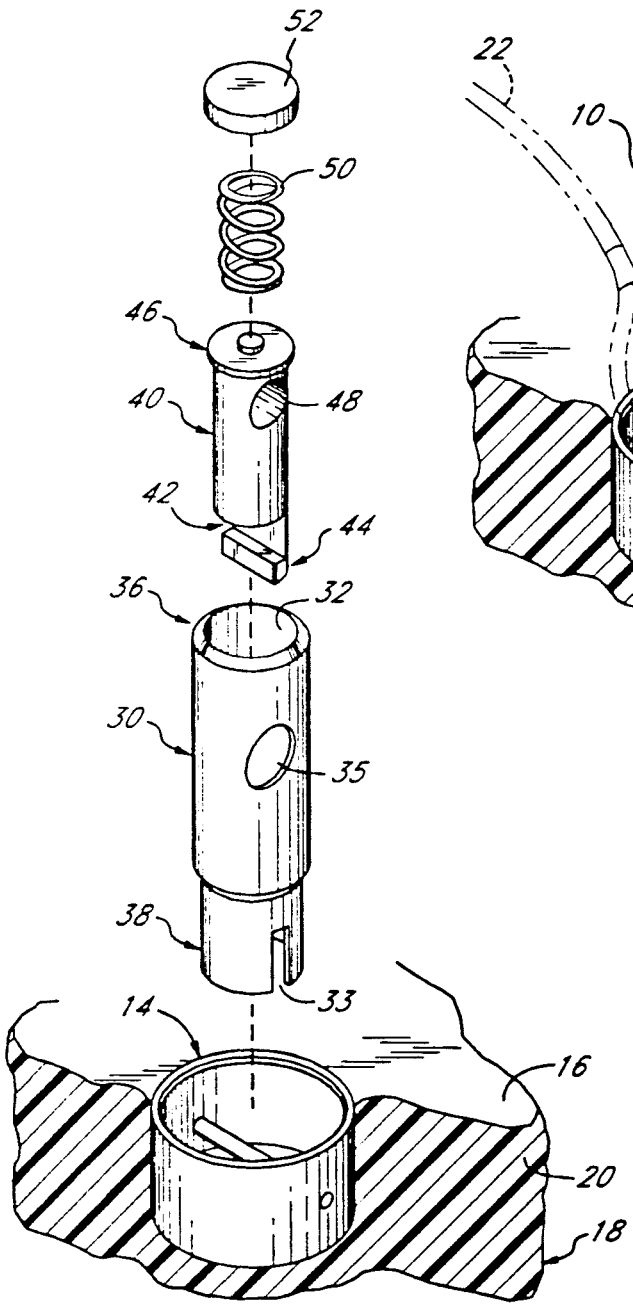
FIG. 2 is an exploded perspective view of the lock apparatus of FIG. 1.

As best shown in FIG. 2, the lock apparatus 10 includes a casing 30, a bolt 40, a spring 50, and a cap 52. The casing is tubular, and generally has a cylindrical external shape with an inner bore 32. The inner bore 32 extends longitudinally through the casing 30. Preferably, the inner bore 32 has a circular cross section. Additionally, the inner bore 32 of the preferred embodiment includes a counter bore 34 extending longitudinally from a top end 36 of casing 30 to a point spaced from an engagement end 38, as is best seen in FIGS. 3 and 4. The exterior shape of casing 30 parallels the inner diameters 32, 34. At the casing engagement end 38, the outer diameter of the casing 30 is less that the inner diameter of the leash plug 14. As a result, the casing 30 may be inserted into the leash plug 14 without removal of the existing leash cord 22.

A pair of diametrically opposed parallel slots 33 extend longitudinally from the casing engagement end 38 towards the top end 36. The width of the slots 33 is greater than the diameter of the cross bar 12, enabling the casing 30 to receive and surround the cross bar 12 when inserting the casing 30 into the leash plug 14. A hole 35, proximal to the casing top end 36, extends entirely through the casing 30.

Referring to FIGS. 2, 3 and 4, the bolt 40 is generally cylindrical in shape with a diameter less than the diameter of the casing inner diameter 32. The bolt 40 includes a portion of reduced cross section forming a notch 42 proximal to an engagement end 44 of the bolt 40. The bolt 40 further includes a flared head 46 defined by a circular flange, the diameter of which is greater than the diameter of the casing inner diameter 32, but less than the diameter of the casing counter bore 34. The flared head could alternatively be formed by a pin protruding from the sides of the bolt 40, or any other structure which effectively increases the diameter of the bolt 40 so that the bolt cannot slide out of the casing. A hole 48 extends through the bolt 40 proximal to the flared head 46. The bolt hole 48 must align with the holes 35 in the casing to permit a padlock shackle 24 to pass through. The common axis of the holes 35, 48 is transverse to the longitudinal axis of the casing inner diameter 32, and preferably is normal thereto.

In assembly, as shown in FIG. 4, the bolt 40 is positioned within the casing 30. The cap 52 is press fit into the counter bore 34 at the casing top end 36, thereby enclosing the casing 30. The spring 50 is positioned within the casing 30 between the bolt flared head 46 and the cap 52. The spring 50 biases the flared head 46 against a step 37 formed between the inner bore 32 and the counter bore 34 of the casing 30. In this "unlock" position, a portion of the bolt 40 extends beyond the engagement end 38 of the casing 30, exposing the notch 42, as shown in FIG. 4.

In operation, the extending bolt 40 is inserted within the leash plug 14. As shown in FIG. 3, an end portion 41 of the bolt 40 slides between a leash plug bottom surface 15 and the cross bar 12 in a manner receiving the cross bar 12 within the notch 42. The casing 30 slides longitudinally over the bolt 40 and receives the cross bar 12 within the slots 33, thereby surrounding the cross bar 12. In this "lock" position, the bolt hole 48 and the casing holes 35 align and allow the insertion of the padlock shackle 24 to pass though the aligned holes 35, 48 (as shown in FIG. 1), thereby preventing movement of the bolt 40 relative to the casing 30 and locking the lock apparatus 10 to the cross bar 12. Ends of an substantially unseverable, preferably metallic, cable 26 are then looped around or affixed to a stationary object and locked together by a padlock 28 or a like item. Selective access to the padlock 28 can be provided by a key, number combination or other methods. In this manner, the surfboard 18 is secured from theft without damaging or altering the existing structure of the surfboard. Further, attachment of the lock apparatus 10 to the surfboard 18 does not require the removal of the leash cord 22 or any other structure from the surfboard 18.

Figure 5:
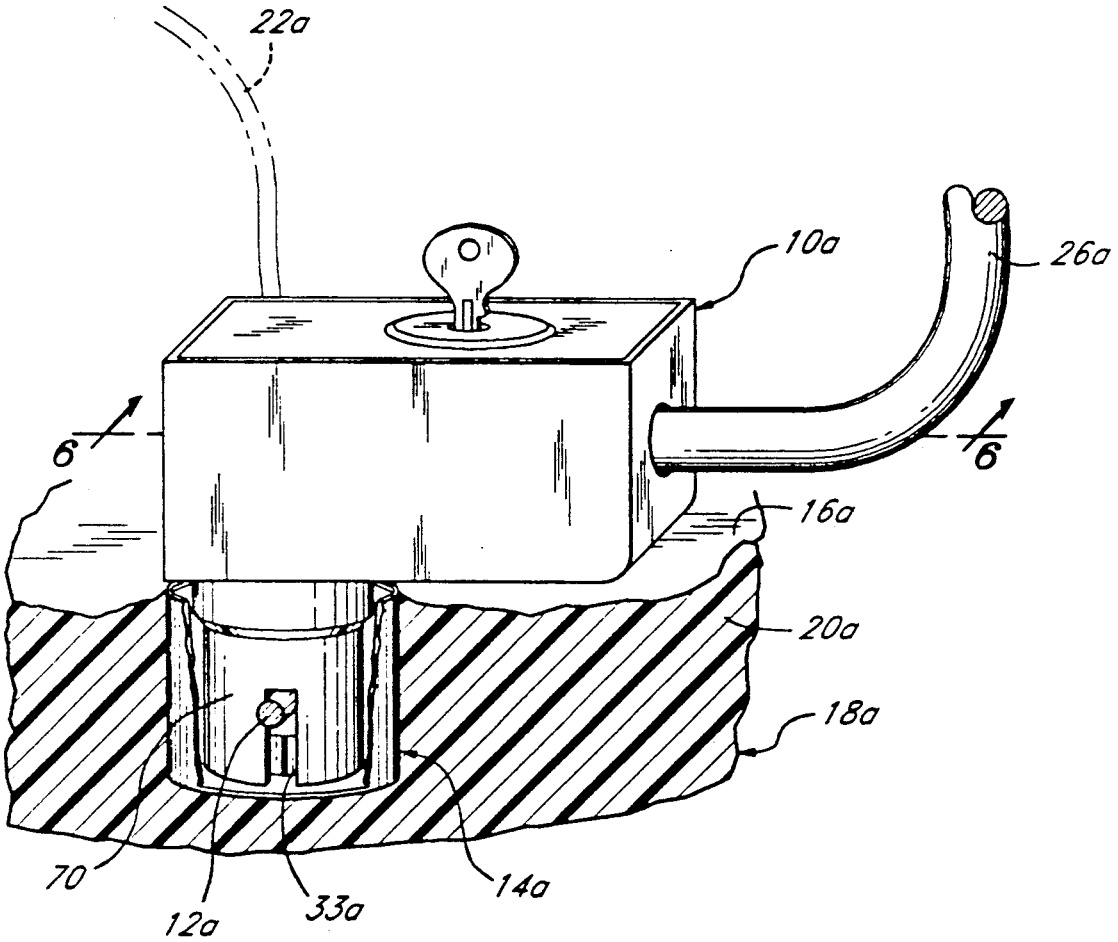
FIG. 5 is a perspective view of another preferred embodiment of the present invention, secured to a cross bar of a surfboard leash plug.
Figure 6:
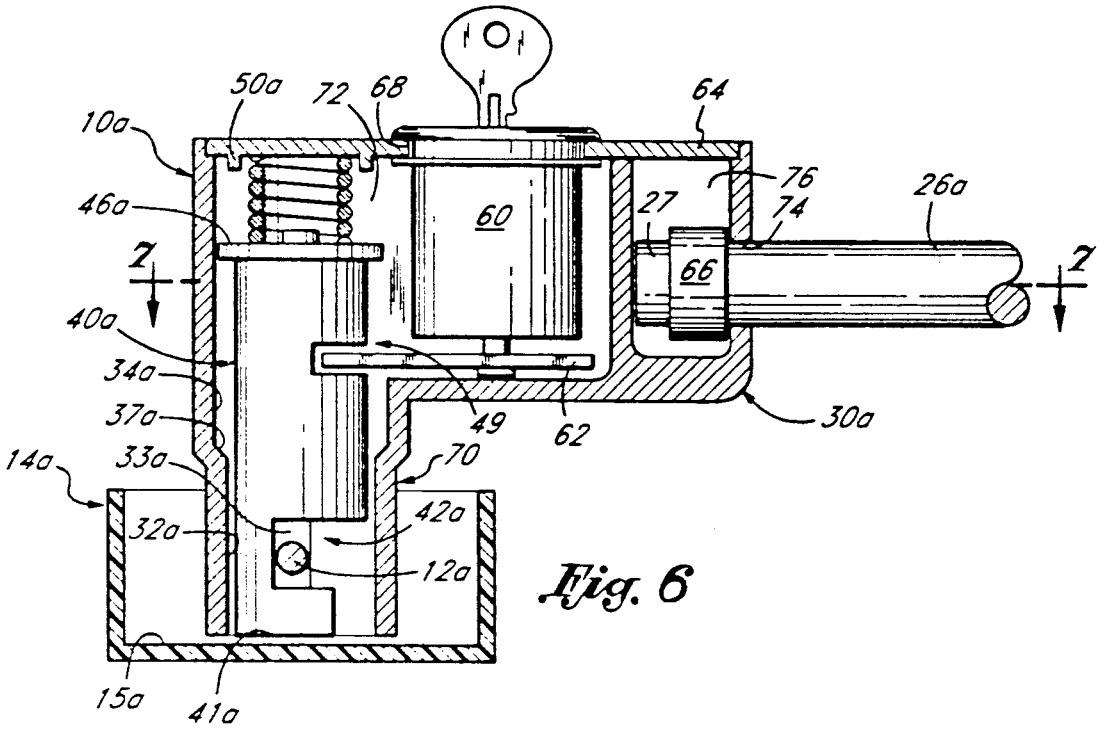
FIG. 6 is a cross-sectional view taken along line 6—6 showing the lock apparatus in the lock position secured to the cross bar.
Figure 7:
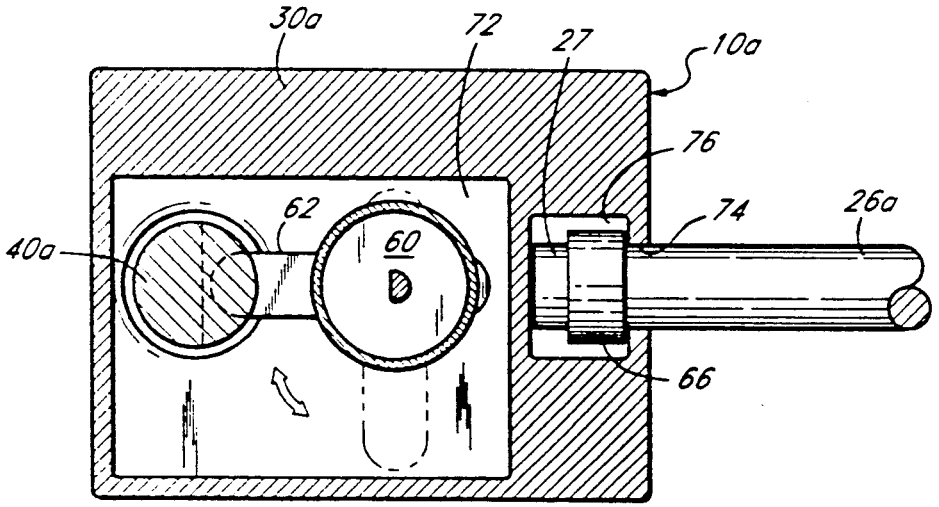
FIG. 7 is a top plan view of the lock apparatus of FIG. 6 taken along line 7—7.

FIG. 5 shows another preferred embodiment of the invention attached to an existing cross bar **12*a* of a standard leash plug 14*a*. Where appropriate, like numbers with an "a" suffix have been used to indicate like parts of the two embodiments for ease of understanding. As shown in FIG. 6, a lock apparatus 10*a* includes a casing 30*a*, a bolt 40*a*, a lock cylinder 60, a throw lever 62, a spring 50*a*, a top plate 64 and a cable 26*a*. The casing 10*a* is generally rectangular in shape and includes projecting tubular structure 70 having an inner bore 32*a*. Preferably, the inner bore 32*a* has a circular cross section. Additionally, the inner bore 32*a* includes a counter bore 34*a* extending longitudinally outward from the casing 10*a* into the projecting structure 70. The projecting structure 70 includes a pair of diametrically opposed parallel slots 10*a* at the end of projecting structure 70 extending towards the casing 10*a*. As shown in FIGS. 6 and 7, the casing 10*a* further includes a first cavity 72 adapted to receive the lock cylinder 60 and the throw lever 62. The inner bore 32*a* opens into the first cavity 72. The casing 10*a* also includes a hole 74 in one side wall opening into a second cavity 76 in the casing 10*a***.

The outer surface of the projecting structure 70 parallels the bores **32*a*, 34*a*. At the slotted end of the projecting structure 70, the outer diameter of the tubular projecting structure 70 is less than the diameter of leash plug 14*a*. As a result, the projection 70 may be inserted into the leash plug 14*a* without removal of the existing leash cord 22*a***.

The bolt **40*a* is generally cylindrical in shape and sized to fit within the casing inner bore 32*a*. The bolt 40*a* includes a portion of reduced cross section forming a notch 42*a* adapted to receive the cross bar 12*a* proximal to one end, a flared head 46*a* in the form of a circular flange at the opposite end of the bolt 40*a*, and a groove 49. The groove is transverse and preferably normal to longitudinal axis of the bolt 40*a*, is proximal to the flared head 46*as*, and is adapted to receive the throw lever 62**.

An end 27 of the cable **26*as* extends through the hole 74 into the second cavity 76 of the casing 10*a*. A ferrule ring 66 fits over the end 27 of the cable 26*a*, thereby preventing the cable end 27 from slipping out of the casing 10*a***.

The top plate 64 covers the cavities 72, 76 of the casing **10*a* and can be affixed to the casing 10*a* in any one of a variety of a known manners, e.g., press fitting. The top plate 64 includes an aperture 68 through which the lock cylinder 60** is placed.

The throw lever 62 is coupled to the lock cylinder 60 in a manner communicating rotation of the lock cylinder 60 to the throw lever 62. Throw lever 62 engages the groove 49 on the bolt **40*a* with the bolt 40*a* in the lock position, as shown in FIG. 6. Other mechanisms, however, may be employed to selectively move the throw lever 62 into engagement with the groove 49 on the bolt 40*a* when the bolt is in the lock position. The essential criteria is that only selective individuals, i.e., authorized persons, may invoke the movement the throw lever 62 in and out of engagement with the bolt 40*a***.

In assembly, as shown in FIG. 6, the spring **50*a* is placed between the bolt 40*a* and the top plate 64. In the unlock position, biased by the spring 50*a*, the bolt 40*a* extends beyond the slotted end of the tubular projecting structure 70, thereby exposing the notch 42*a*. In this position, the flared head 46*a* abuts a shoulder 37*a* formed between the stepped diameters of the bores 32*a*, 34*a*. The extending bolt 40*a* fits within the leash plug 14*a*. As shown in FIG. 6, the end portion 41*a* of the bolt 40*a* slides between a leash plug bottom surface 15*a* and the cross bar 12*a* in a manner receiving the cross bar 12*a* within the notch 42*a*. The tubular projection 70 of the casing 10*a* slides over the bolt 40*a* and receives the cross bar 12*a* within the slots 33*a*, thereby surrounding the cross bar 12*a*. In this position, the groove 49 in the bolt 40*a* and the throw lever 62 are co-planer, and rotation of the lock cylinder 60 rotates the throw lever 62 from a non-engagement position to an engagement position with the bolt 40*a* in the lock position, as shown in FIG. 7. In this manner, the lock apparatus 10*a* is locked onto the cross bar 12*a*. By securing the other end of the cable 26*as* to a generally stationary object, the surfboard 18*a* is secured from theft without damaging or altering the existing structure of the surfboard 18*a***.

Modifications and variations of the embodiments described above may be made by those skilled in the art while remaining within the true scope and spirit of this invention. For example, the lock apparatus may be used with any article which has a cross bar. For example, the tubular frame of a bicycle can be considered a "cross bar." The "cross bar" could also be a cable or other structure which is secured to the article to be locked, and need not be rigid or embedded within the article as long as it is securely fastened to the article.

Likewise, the device may be designed so that the movement of the bolt within the casing from a unlock to a lock position may be longitudinal, traverse, rotational or a combination thereof.

Additionally, a variety of slot and notch shapes are possible to lock the cross bar between the casing and the bolt. For example, the pair of parallel slots 33 adapted to receive the cross bar 12 may be generally formed in an L-shape, with the transverse portion of the slot shape positioned distal from the engagement end of the casing. Correspondingly, the bolt may include a portion of reduced cross section extending from the end of the bolt for a distance greater than the longitudinal length of the slots. In this manner, the casing could slide longitudinally over the cross bar and then slide transversely to a position preventing longitudinal movement of the casing relative to the cross bar. The bolt could subsequently slide longitudinally within the casing bore to a position preventing transverse movement of the casing relative to the cross bar. Accordingly, the cross bar is locked between the casing and the bolt in a similar manner to that disclosed in reference to the preferred embodiments.

What is claimed is:

1. A lock apparatus, attachable to a cross bar positioned in an article, comprising:

a tubular casing, said casing comprising a longitudinal inner bore, said inner bore including a counterbore, said inner bore including a counterbore, a transverse hole through said casing proximal to one end of said casing, and a pair of diametrically opposite parallel slots extending longitudinally from the other end, said slots adapted to receive said cross bar; and a bolt adapted to slide within said casing inner bore and to extend beyond the slotted end of said casing, said bolt including a transverse hole proximate to one end and a reduced cross sectional portion forming a notch proximal to the other end of said bolt, said notch adapted to receive said cross bar when said bolt is extended, said bolt further including a flared head at the end of said bolt distal from said notch such that said bolt is prevented from sliding out of said casing, the hole of said bolt positioned such that the hole of said bolt aligns with the hole of said casing in a manner to receive a locking member through said holes to prevent said notch from extending beyond said casing with said cross bar locked between said notch and said casing.

* * * * *